US006163901A

United States Patent [19]

Sargent

[11] Patent Number: 6,163,901

[45] Date of Patent: Dec. 26, 2000

[54] BLANKET ELEVATION DEVICE

[76] Inventor: Frank Edrick Sargent, 120 Ankeny, San Francisco, Calif. 94134

[21] Appl. No.: 09/295,226

[22] Filed: Apr. 19, 1999

[51] Int. Cl.[7] ..... A47C 21/02

[52] U.S. Cl. ..... 5/505.1; 5/504.1

[58] Field of Search ..... 5/503.1, 504.1, 5/505.1, 506.1, 658, 659

[56] References Cited

U.S. PATENT DOCUMENTS

| | | | |
|---|---|---|---|
| D. 372,822 | 8/1996 | O'Brien | D6/503 |
| 1,072,490 | 9/1913 | Oilar | 5/505.1 |
| 2,602,171 | 7/1952 | Good | 5/505.1 |
| 2,607,933 | 8/1952 | Fulton | 5/505.1 |
| 3,639,929 | 2/1972 | Ichise | 5/504.1 X |
| 4,287,622 | 9/1981 | Lane | 5/505.1 |
| 4,975,997 | 12/1990 | Misiura et al. | 5/505.1 |
| 5,203,042 | 4/1993 | Mason | 5/505.1 X |
| 5,329,658 | 7/1994 | Fontenot et al. | 5/505.1 |

*Primary Examiner*—Terry Lee Melius
*Assistant Examiner*—Robert G. Santos
*Attorney, Agent, or Firm*—Goldstein & Canino

[57] ABSTRACT

A blanket elevation device including a pair of spacers that are positioned between the upper mattress and the lower box spring at a foot of the bed on opposing sides thereof for supporting a blanket at a raised elevation with respect to an upper surface of the upper mattress.

1 Claim, 2 Drawing Sheets

BLANKET ELEVATION DEVICE

BACKGROUND OF THE INVENTION

The present invention relates to a blanket elevation device and more particularly pertains to elevating a blanket off of feet of a person lying in bed.

Many people suffer from a variety of different ailments. Some of these ailments involve the feet and the ankles. When a person suffering from these ailments wishes to lay down in bed, they expect to be comfortable. In order to keep warm, a blanket or the like is used to cover the person. Unfortunately, the blanket will become an impediment to the health and comfort of the foot or ankle problem. The blanket becomes a problem because it rests on top of the feet and will prevent the person from turning comfortably without having the blanket becoming tangled with their feet. The present invention seeks to provide a device that will elevate a blanket to a positioned whereby the feet and ankles will still be covered, but the blanket will not impede any movement of the person under the blanket. This will prevent further injury and/or discomfort.

The use of adjustable beds is known in the prior art. More specifically, adjustable beds heretofore devised and utilized for the purpose of adjusting a bed to meet the comfort of a particular user are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,109,872 to Conn discloses a bedding support device capable of elevating a blanket and preventing it from interfering with a patient's leg movements. U.S. Pat. No. 4,899,404 to Galumbeck discloses a means for elevating the head section of a bed at varying angles to provide support positions. U.S. Pat. No. 4,095,296 to Ferro discloses an adjustable bed with means to elevate the upper leg section. U.S. Pat. No. 4,942,633 to Thomas discloses an adjustable bed.

While these devices fulfill their respective, particular objective and requirements, the aforementioned patents do not describe a blanket elevation device for elevating a blanket off of feet of a person lying bed.

In this respect, the blanket elevation device according to the present invention substantially departs from the conventional concepts and designs of the prior art, and in doing so provides an apparatus primarily developed for the purpose of elevating a blanket off of feet of a person lying bed.

Therefore, it can be appreciated that there exists a continuing need for new and improved blanket elevation device which can be used for elevating a blanket off of feet of a person lying bed. In this regard, the present invention substantially fulfills this need.

SUMMARY OF THE INVENTION

In the view of the foregoing disadvantages inherent in the known types of adjustable beds now present in the prior art, the present invention provides an improved blanket elevation device. As such, the general purpose of the present invention, which will be described subsequently in greater detail, is to provide a new and improved blanket elevation device and method which has all the advantages of the prior art and none of the disadvantages.

To attain this, the present invention essentially comprises a bed comprised of an upper mattress and a lower box spring. A pair of inverted U-shaped spacers are positioned between the upper mattress and the lower box spring at a foot of the bed on opposing sides thereof for supporting a blanket at a raised elevation with respect to an upper surface of the upper mattress. Each of the spacers are defined by an upper horizontal component, a lower horizontal component, and a vertical component disposed therebetween. The lower horizontal components are positioned between the upper mattress and the lower box spring whereby the vertical components abut opposing side surfaces of the upper mattress and the upper horizontal components are elevated above the upper surface of the upper mattress for supporting the blanket thereon and creating a space between the blanket and the upper surface of the upper mattress.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved blanket elevation device which has all the advantages of the prior art adjustable beds and none of the disadvantages.

It is another object of the present invention to provide a new and improved blanket elevation device which may be easily and efficiently manufactured and marketed.

It is a further object of the present invention to provide a new and improved blanket elevation device which is of durable and reliable construction.

An even further object of the present invention is to provide a new and improved blanket elevation device which is susceptible of a low cost of manufacture with regard to both materials and labor, and which accordingly is then susceptible of low prices of sale to the consuming public, thereby making such a blanket elevation device economically available to the buying public.

Even still another object of the present invention is to provide a new and improved blanket elevation device for elevating a blanket off of feet of a person lying bed.

Lastly, it is an object of the present invention to provide a new and improved blanket elevation device including a pair of spacers that are positioned between the upper mattress and the lower box spring at a foot of the bed on opposing sides thereof for supporting a blanket at a raised elevation with respect to an upper surface of the upper mattress.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
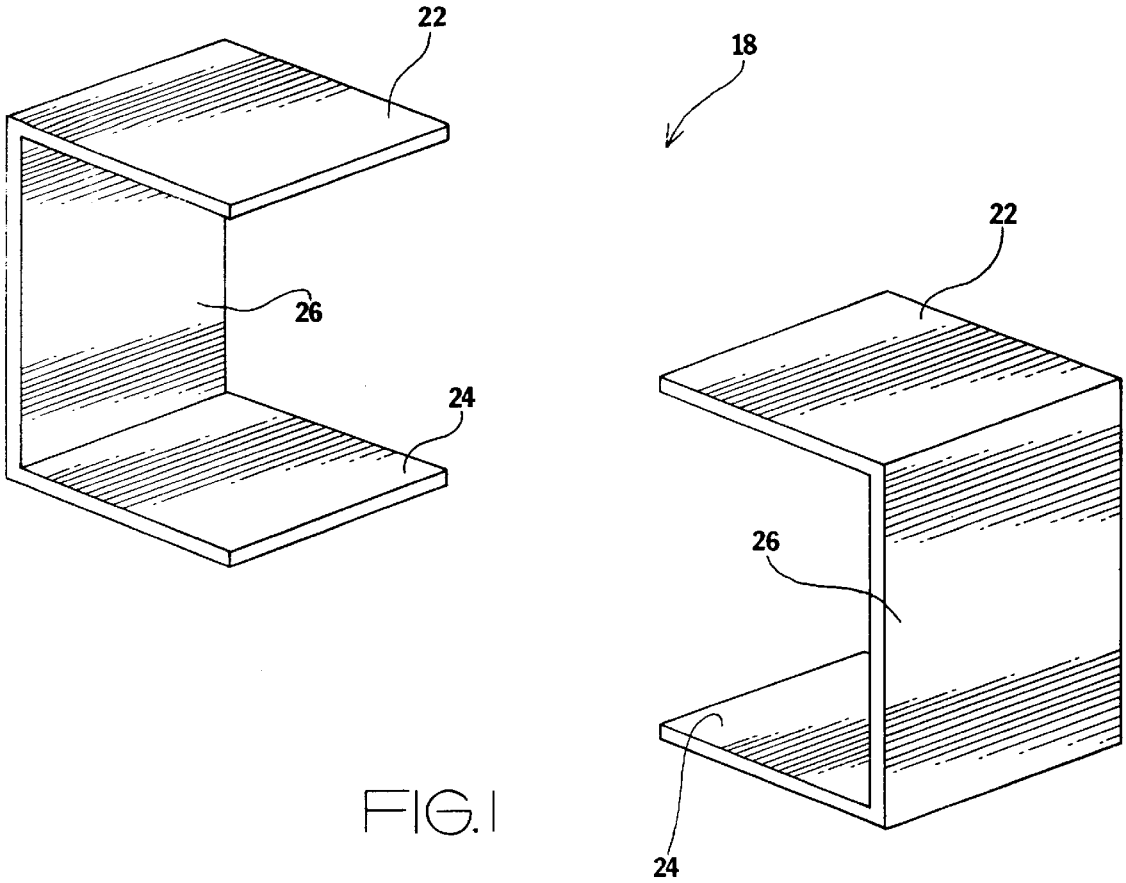
FIG. 1 is a perspective view of the preferred embodiment of the blanket elevation device constructed in accordance with the principles of the present invention.
Figure 2:
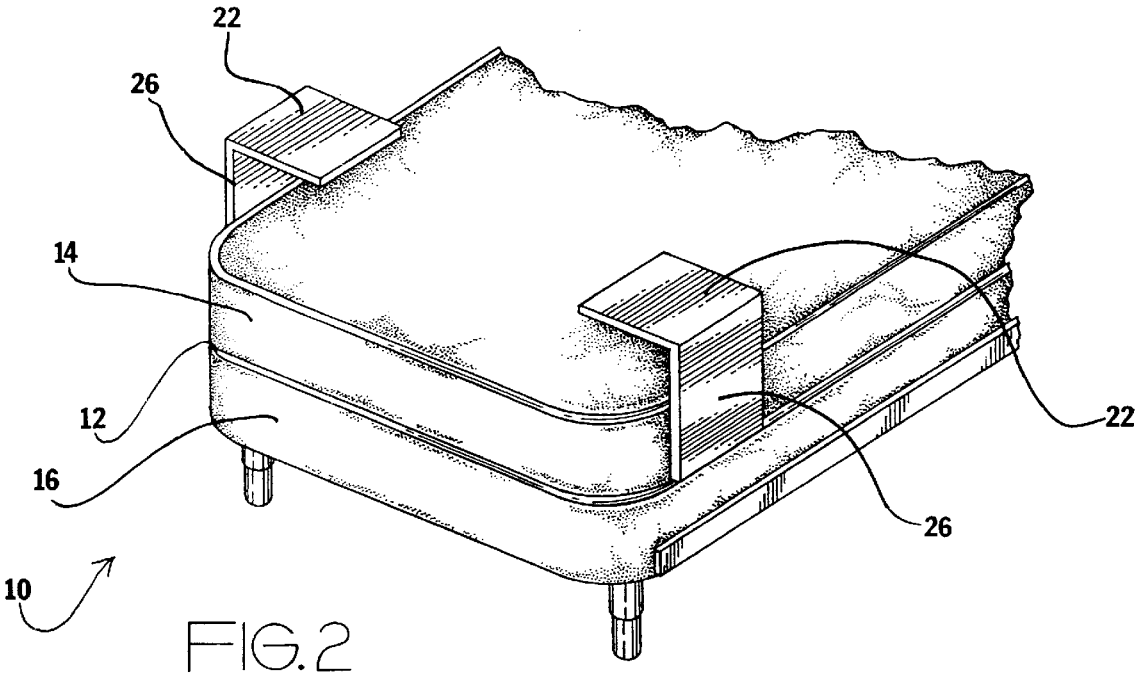
FIG. 2 is a perspective view of the present invention illustrating the U-shaped spacer positioned with respect to a bed.
Figure 3:
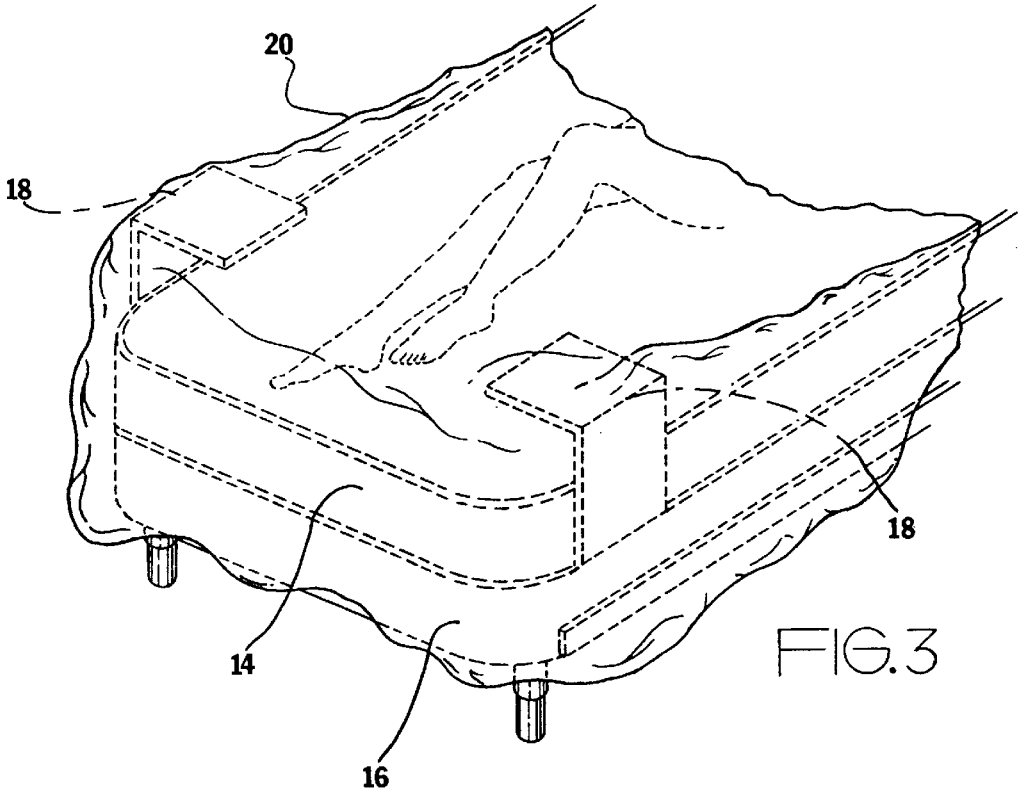
FIG. 3 is a perspective view of the present invention illustrated in use.

With reference now to the drawings, and in particular, to FIGS. 1 through 3 thereof, the preferred embodiment of the new and improved blanket elevation device embodying the principles and concepts of the present invention and generally designated by the reference number 10 will be described.

Specifically, it will be noted in the various Figures that the device relates to a blanket elevation device for elevating a blanket off of feet of a person lying bed. In its broadest context, the device consists of a bed and a pair of inverted U-shaped spacers. Such components are individually configured and correlated with respect to each other so as to attain the desired objective.

The bed 12 is comprised of an upper mattress 14 and a lower box spring 16. The bed is the type known in the art and could be used with any size bed.

The pair of inverted U-shaped spacers 18 are positioned between the upper mattress 14 and the lower box spring 16 at a foot of the bed 12 on opposing sides thereof for supporting a blanket 20 at a raised elevation with respect to an upper surface of the upper mattress 14. Each of the spacers 18 are defined by an upper horizontal component 22, a lower horizontal component 24, and a vertical component 26 disposed therebetween. The lower horizontal components 24 are positioned between the upper mattress 14 and the lower box spring 16 whereby the vertical components 26 abut opposing side surfaces of the upper mattress 14 and the upper horizontal components 22 are elevated above the upper surface of the upper mattress 14 for supporting the blanket 20 thereon and creating a space between the blanket 20 and the upper surface of the upper mattress 14. This space provides a place for safely positioning ones feet while in the bed 12 thereby allowing for free rotation and turning of the body without risk of entangling the feet and ankles with the blanket 20.

As to the manner of usage and operation of the present invention, the same should be apparent from the above description Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A blanket elevation device for elevating a blanket off of feet of a person lying in bed comprising, in combination:

a bed comprised of an upper mattress and a lower box spring;

a pair of inverted U-shaped spacers positioned between the upper mattress and the lower box spring at a foot of the bed on opposing sides thereof for supporting a blanket at a raised elevation with respect to an upper surface of the upper mattress, each of the spacers being defined by an upper horizontal component, a lower horizontal component, and a vertical component disposed therebetween, the lower horizontal components are not connected to each other and being positioned between the upper mattress and the lower box spring whereby the vertical components abut opposed side surfaces of the upper mattress and the upper horizontal components are not connected to each other and are elevated above the upper surface of the upper mattress for supporting the blanket thereon and creating a space between the blanket and the upper surface of the upper mattress.

* * * * *